United States Patent [19]

Jones, Jr.

[11] 4,010,470

[45] Mar. 1, 1977

[54] MULTI-FUNCTION INTEGRATED RADOME-ANTENNA SYSTEM

[75] Inventor: Howard S. Jones, Jr., Washington, D.C.

[73] Assignee: The United States of America as represented by the Secretary of the Army, Washington, D.C.

[22] Filed: Mar. 10, 1976

[21] Appl. No.: 665,665

[52] U.S. Cl. ..... 343/708; 343/846

[51] Int. Cl.[2] ..... H01Q 1/28

[58] Field of Search ..... 343/700 MS, 705, 708, 343/872, 846

[56] References Cited

UNITED STATES PATENTS 2,990,546 6/1961 Haas ..... 343/705

*Primary Examiner*—Eli Lieberman

*Attorney, Agent, or Firm*—Nathan Edelberg; Robert P. Gibson; Saul Elbaum

[57] ABSTRACT

A radome-integrated conformal parallel plate radiator for a projectile. An antenna system consisting of open-ended dielectric load cavity radiators is incorporated into a dielectric radome structure for space conservation and operational versatility. A plurality of individual radiating elements, preferably in the form of wedge-shaped metallic radiators, are flush-mounted on the non-planar surface of a projectile's radome. The interior surface of the hollow radome includes either a solid conductive ground plane deposited thereon or a wire screen mesh ground plane which is transparent to certain frequencies. Each of the exterior mounted wedge-shaped radiators are short-circuited to the ground plane, and may be individually excited and controlled to produce a desired radiation pattern.

10 Claims, 4 Drawing Figures

MULTI-FUNCTION INTEGRATED RADOME-ANTENNA SYSTEM

RIGHTS OF THE GOVERNMENT

The invention described herein may be manufactured, used, and licensed by or for the United States Government for governmental purposes without the payment to me of any royalty thereon.

BACKGROUND OF THE INVENTION

1. Field of the Invention

This invention is related to parallel plate radiators and, more particularly, is directed towards parallel plate radiators whose design is integrated with and conformal to the ogive of a projectile's radome structure.

2. Description of the Prior Art

Conventional antenna designs utilized in projectiles are large, bulky, waveguide, coaxial or strip line structures that are mounted inside of the projectile's radome. Aside from the space they occupy, these antennas have to be designed to radiate through an air space as well as through the wall of the radome, which tends to make such systems inefficient.

Antenna designs which are incorporated into and integral with a nose cone of a projectile are known, as exemplified by my prior U.S. Pat. No. 3,798,653. In my prior patent there is disclosed a small, compact, and efficient antenna that utilizes very little space and is employed on the tip of a projectile. The antenna therein described is in the form of a nose cone body having an electrically conductive inner surface which extends about the base of the nose cone and partially coats the outside thereof. The antenna is excited by a coaxial probe connected to the metal coating on the inside of the nose cone.

While compact, my earlier antenna is limited in versatility and hence, in usefulness. Being but a single radiating element, by earlier system is necessarily limited in its possible radiation patterns, modes of excitation, and the like. Further, the solid conductive inner coating utilized precludes the use of that antenna with additional antennas or antenna systems positioned interiorly of the nose cone, the solid copper ground plane being substantially opaque to higher frequencies.

Open circuit parallel plate radiators are also known, and generally consist of a ground plane on top of which is placed a variably sized metallic radiating element in an open-circuit relationship. While useful, such designs have inherent design limitations inasmuch as the radiation frequency or tuning is controllable only as a function of the size of the radiating element.

It is therefore apparent that it would be highly advantageous if an improved radiating element could be provided which is at least as compact as that presented in my prior patent discussed above, but which further adds multi-function versatility to the design of projectile antenna systems.

OBJECTS AND SUMMARY OF THE INVENTION

It is therefore a primary object of the present invention to provide an antenna system consisting of multi-function open-ended dielectric load cavity radiators integrated into a dielectric radome structure of a projectile.

Another object of the present invention is to provide a radome antenna system which utilizes radiator elements which occupy virtually no space interiorly of the radome and which are flush mounted exteriorly thereof to conform with the surface of the radome.

Another object of the present invention is to provide a radome-integrated conformal parallel plate radiator system for a projectile which may take the form of any projectile configuration, such as conical, ogival, cylindrical, hemispherical, or the like.

A still further object of the present invention is to provide a radome-integrated conformal parallel plate radiator for a projectile which is capable of producing a multitude of different radiation patterns, such as axial, radial, circumferential, omnidirectional, or the like.

An additional object of the present invention is to provide a multi-function integrated radome antenna system which conserves a substantial amount of space by integrating the radome and the radiator elements, thereby also providing a substantial savings in production costs.

A still additional object of the present invention is to provide a radome-integrated conformal parallel plate radiator system for a projectile in which a plurality of radiators may be individually controlled on a single radome with a common conducting ground plane to provide a versatility and controllability heretofore unobtainable.

It is a still further object of the present invention to provide a radome-integrated conformal parallel plate antenna system which is capable of multi-frequency radiation, and which is compatible with other high-frequency antenna systems already existing in many projectiles.

The foregoing and other objects are attained in accordance with one aspect of the present invention through the provision of a radome-integrated conformal parallel plate radiator for a projectile which comprises a dielectric radome shaped to conform to the forward portion of the projectile. The radome has a non-planar exterior wall and an interior wall which is substantially parallel to the exterior wall. A metallic ground plane is formed on the interior wall of the radome, and wedgeshaped metallic coating means are deposited on the exterior wall of the radome. The wedge-shaped coating means are electrically short-circuited to the metallic ground plane. In one embodiment, the metallic ground plane may comprise a solid metallic coating on the interior wall, while in an alternative embodiment the metallic ground plane comprises a wire screen mesh on the interior wall of the radome which is transparent to higher frequency signals which may emanate from other antenna systems of the projectile.

In accordance with other aspects of the present invention, the wedge-shaped metallic coating means comprises one or a plurality of metallic wedge radiators, each of which has a base portion disposed about the open end of the dielectric radome. The width of the base portion is greater than the width of the tip portion of each metallic wedge radiator, the base portion being electrically connected to the metallic ground plane by a metallic short circuit covering the base of the radome. Each of the wedge-shaped metallic radiators are individually excitable and controllable via a plurality of coaxial connectors positioned on the interior wall of the radome. The radome and the antenna structures are thereby integrated without sacrifice of antenna performance or loss of structural integrity.

BRIEF DESCRIPTION OF THE DRAWINGS

Other objects, aspects, uses, and advantages of the present invention will be more fully appreciated when considered in connection with the following detailed description of the present invention viewed in conjunction with the accompanying drawings, in which.

DETAILED DESCRIPTION OF THE PREFERRED EMBODIMENTS

Figure 1:
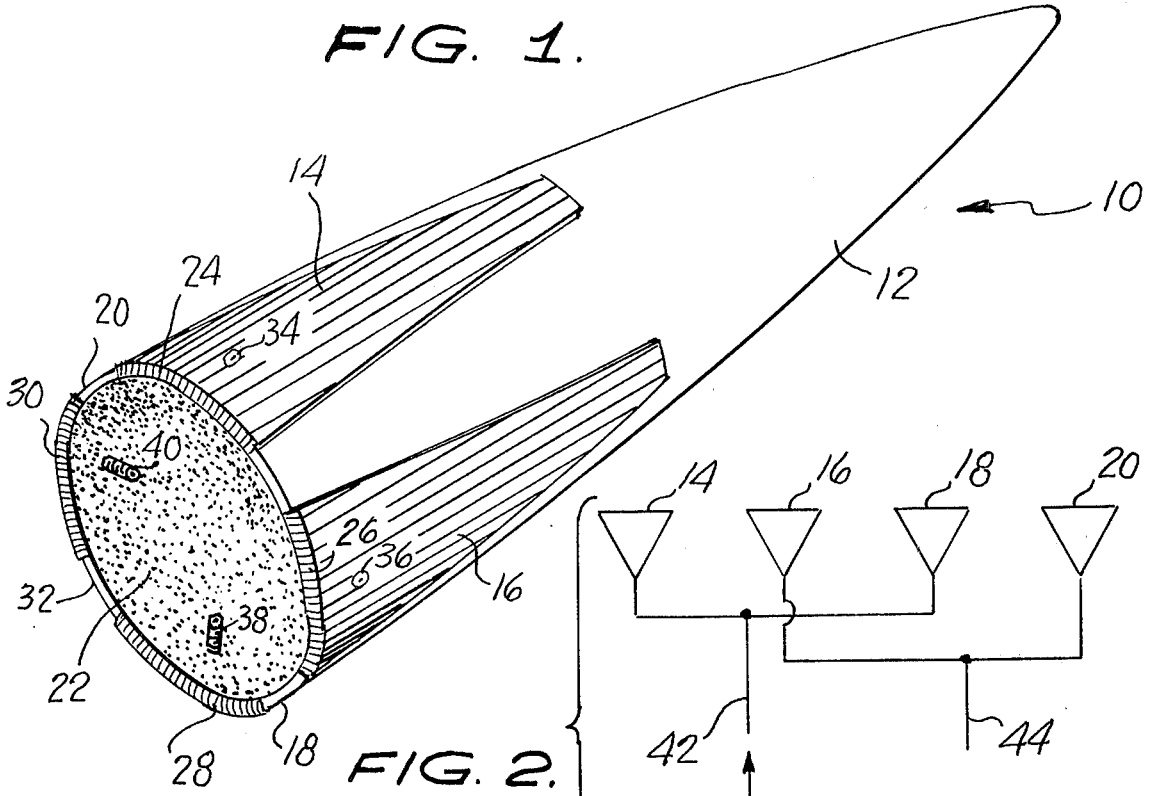
FIG. 1 is a perspective view of a preferred embodiment of the present invention.

Referring now to the drawings, wherein like reference numerals designate identical or corresponding parts throughout the several views, and more particularly to FIG. 1 thereof, the radome-integrated conformal parallel plate radiator for a projectile is designed generally by the reference numeral 10. Reference numeral 10 indicates in this embodiment a generally conical radome which includes an uncoated dielectric portion 12 on the outer periphery of which is plated four wedge-shaped metallic, preferably copper, radiating elements 14, 16, 18 and 20.

On the inner surface of the conical radome 10 is a solid metallic coating 22 which may, for example, comprise copper, and serves as a conducting ground plane for each of the wedge-shaped parallel plate radiators 14, 16, 18 and 20.

Each of the wedge-shaped parallel plate radiators 14, 16, 18 and 20 are, in this embodiment, comprised of congruent, substantially similarly sized wedge-shaped elements having a base portion adjacent the base 32 of radome 10. The base portions are substantially wider than the tip portions of the radiators which are located at approximately the mid-length of the randome 10. Each of the wedge-shaped radiators 14, 16, 18 and 20 are connected to the interior metallic ground plane 22 via connecting metallic short circuits 24, 26, 28 and 30, respectively, so as to form true short-circuited parallel plate radiating elements.

Each of the parallel plate radiating elements 14, 16, 18 and 20 may be independently excited via four interiorly located coaxial feed connectors 34, 36, 38 and 40, respectively.

Figure 2:
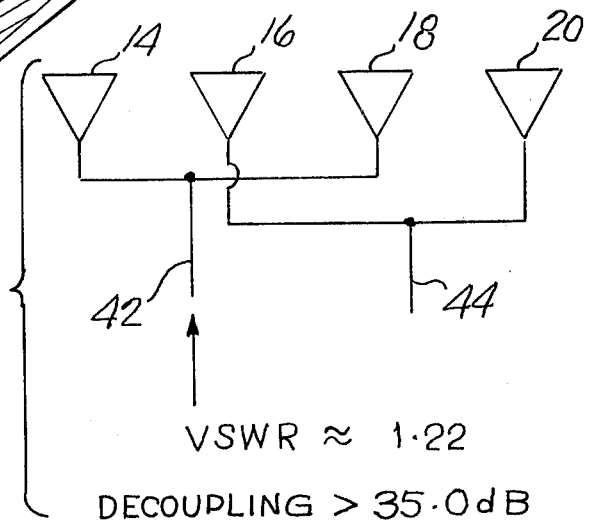
FIG. 2 is a schematic representation of a particular mode of excitation of the preferred embodiment illustrated in FIG. 1.
Figure 4:
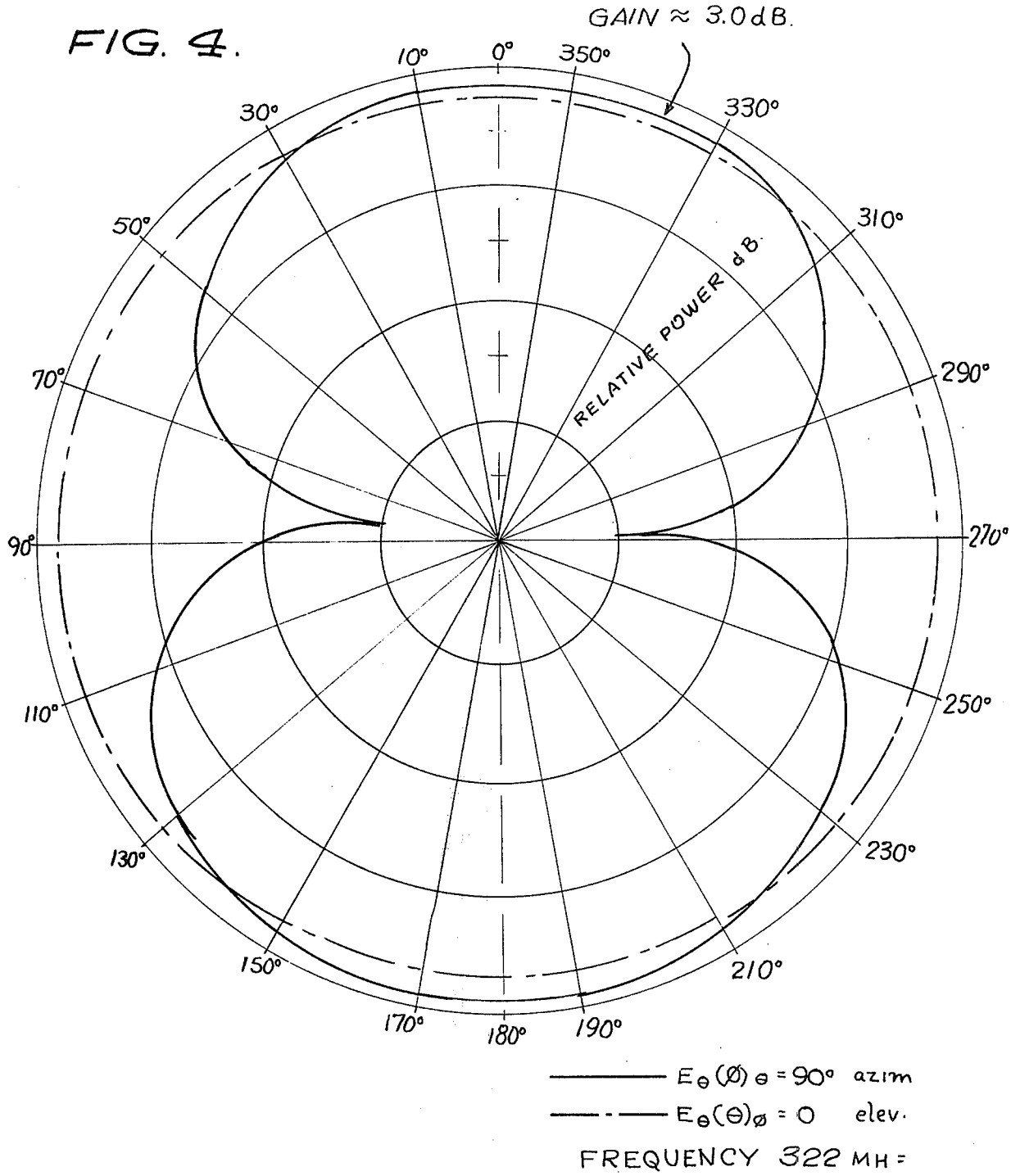
FIG. 4 illustrates the radiation patterns of the first preferred embodiment of the present invention (FIG. 1) excited in accordance with the mode schematically illustrated in FIG. 2.

In the preferred embodiment illustrated in FIG. 1, four radiating elements of substantially the same size and congruent shape are typically mounted on a five-inch diameter projectile, the radiation pattern for which is naturally dependent upon the geometry of the body upon which the elements are mounted. Typical of the radiation patterns obtainable from the preferred embodiment illustrated in FIG. 1 are illustrated in FIG. 4. In this instance, the wedge-shaped parallel plate radiating elements 14 through 20 were excited in accordance with the excitation scheme illustrated in FIG. 2. As therein illustrated, elements 14 and 18 were excited out of phase along feed line 42, while elements 16 and 20 were terminated via line 44. The VSWR looking into radiators 14 and 16 was 1.22 at the center frequency of 322 mHz. and 2.0 to 1.0 or less measured over a 10% bandwidth. The coupling between the pairs of elements 14–18 and 16–20 was greater than 35 dB.

Elements 14 through 20 may be excited in a number of different ways to obtain a variety of antenna pattern configurations, and it should be clear that the size of the elements 14 through 20 may be designed to obtain different frequencies to provide a multi-frequency radiating system.

Conventional organic and inorganic radome materials may be utilized, and are generally comprised of low loss materials such as fused silica. The dielectric constant of the particular dielectric may be varied depending upon the desired application. The inner copper plate surface 22 may be on the order of 0.001 to 0.004 inches thick by utilizing electroless copper plating techniques. The design parameters of each of the radiating elements 14 through 20 include the width of the wedge at its base, its height along the outer surface of radome 10, the thickness of the hollow radome structure itself, and the electrical characteristics of the particular dielectric chosen.

The input feed points 34, 36, 38 and 40 are chosen at points along the interior lengths of the wedge radiators 14 through 20, respectively, on the center line thereof a certain distance from the short-circuited base portions 24, 26, 28 and 30, which distance is selected in accordance with the desired tuning of the individual wedge elements, thereby providing a design factor unobtainable with ordinary open circuit parallel plate radiating elements.

When the radome antenna structure of FIG. 1 is mounted on a projectile or missile, it is capable of producing highly desirable radiation patterns, such as axial, radial, circumferential, omnidirectional, or the like. Multi-element radiators of different positions and sizes may be employed about the circumference of radome 10 in order to obtain desired radiation pattern configurations and multiple frequency operation. The individual radiating elements may be easily matched for low impedances. As a result of the copper plated conducting surface 22 on the inner surface of radome 10, radiation and RF current from the preferred structure of FIG. 1 will be confined to the outer surface of the projectile upon which it is mounted.

However, the design of FIG. 1 also has certain limitations inasmuch as the solid copper plated inner surface 22 eliminates the possible use of a further conventional antenna positioned inside of the radome, since the solid conductive surface presents an opaque barrier to electromagnetic radiation.

Figure 3:
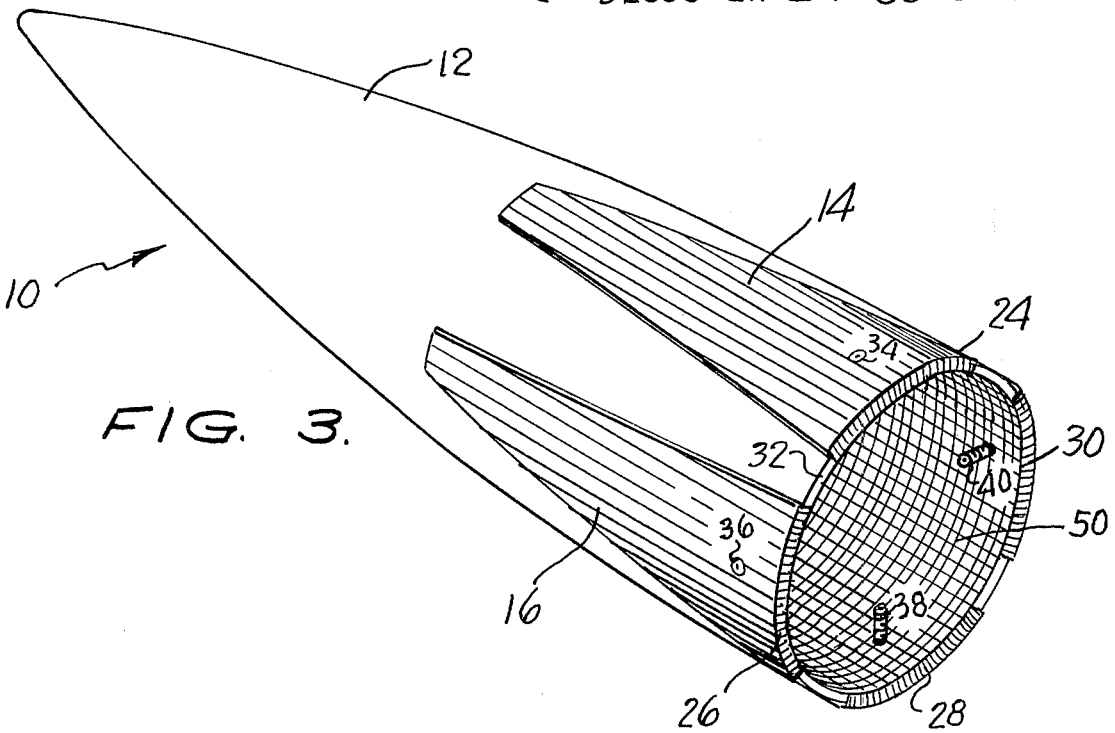
FIG. 3 is a perspective view illustrating an alternative embodiment of the present invention.

Referring now to FIG. 3, there is illustrated an alternative preferred embodiment of the present invention wherein the multi-function parallel plate radiator system is utilized in conjunction with a fine wire screen mesh 50 configured on the inside of the radome. Screen 50 presents a transparent barrier to higher frequency electromagnetic radiation from an optional additional antenna or antenna system positionable within the radome 10, while providing the desired ground plane characteristics at the operating frequency of elements 14 through 20. The perforated or gridded configuration 50 illustrated in FIG. 3 may be copper plated within the entire inner surface of radome 10 or, alternatively, simply in the forward or radiation pattern region of interest. The versatility of the system of the present invention is greatly increased in that a combination of the integrated and separate antenna designs is possible.

It is therefore appreciated that the present invention unifies the previously separate radome and antenna designs and eliminates the large bulky structures of the prior art without scarificing antenna performance or losing any structural integrity of the radome itself. Antenna system design for projectiles and missiles is simplified whereby large savings may be realized in production costs. A sustantial amount of space is conserved for other use, and a milti-function, multi-frequency capability is realized.

The present invention makes possible a combination fuze and guidance antenna system integrated on the same radome surface with an overall cost and complexity that is substantially less than a conventional design would require. The technique of the present invention may be utilized advantageously for the design and construction of high performance antennas for fuzing, guidance, telemetry, sensors, and other military and non-military uses which essentially call for space minimization.

Obviously, numerous variations and modifications of the present invention are possible in light of the above teachings. For example, the invention is equally applicable to missiles and spacecraft. It is therefore to be understood that within the scope of the appended claims, the invention may be practiced otherwise than as specifically described herein.

I claim as my invention:

1. A radome-integrated conformal parallel plate radiator for a projectile which comprises:

a dielectric radome shape to conform to the forward portion of said projectile, said radome having a non-planar exterior wall and an interior wall substantially parallel therewith;

metallic ground plane means formed on said interior wall of said dielectric radome; and wedge-shaped metallic coating means deposited on said exterior wall of said dielectric radome, said wedge-shaped metallic coating means being electrically short-circuited to said metallic ground plane means.

2. The radome-integrated conformal parallel plate radiator as set forth in claim 1, wherein said metallic ground plane means comprises a solid metallic coating deposited on said interior wall of said dielectric radome.

3. The radome-integrated conformal parallel plate radiator as set forth in claim 1, wherein said metallic ground plane means comprises a wire screen mesh disposed adjacent said interior wall of said dielectric radome.

4. The radome-integrated conformal parallel plate radiator as set forth in claim 1, wherein said wedge-shaped metallic coating means comprises a first metallic wedge radiator having a base portion of a width which tapers inwardly to the width of the tip portion, said base portion being electrically connected to said metallic ground plane means by a short circuit portion on the base of said dielectric radome.

5. The radome-integrated conformal parallel plate radiator as set forth in claim 4, wherein said wedge-shaped metallic coating means further comprises a second metallic wedge radiator of a substantially congruent shape to said first metallic wedge radiator, and further comprising first and second connector means mounted on said interior wall of said dielectric radome for independently electrically exciting said first and second metallic wedge radiators.

6. The radome-integrated conformal parallel plate radiator as set forth in claim 1, wherein said wedge-shaped metallic coating means comprises a plurality of metallic wedge radiators, each of which as a base portion and a tip portion, said base portion having a width greater than said tip portion, each of said base portions being electrically connected to said metallic ground plane means by a short circuit plated portion at the base of said dielectric radome.

7. The radome-integrated conformal parallel plate radiator as set forth in claim 6, wherein said dielectric radome comprises a substantially conically shaped hollow ogive having an open end, said plurality of metallic wedge radiators being disposed about the exterior wall of said ogive with their respective base portions adjacent said open end thereof.

8. The radome-integrated conformal parallel plate radiator as set forth in claim 7, further comprising a plurality of coaxial connectors mounted on said interior wall of said ogive, each of said connectors being associated with a single one of said plurality of said metallic wedge radiators for independent electrical excitation thereof.

9. The radome-integrated conformal parallel plate radiator as set forth in claim 8, wherein said metallic ground plane means comprises a solid metallic coating deposited on said interior wall of said dielectric radome.

10. The radome-integrated conformal parallel plate radiator as set forth in claim 8, wherein said metallic ground plane means comprises a wire screen mesh disposed adjacent said interior wall of said dielectric radome.

* * * * *